5/6/80 XR 4,201,985

United States Patent [19]

Inami et al.

[11] 4,201,985

[45] May 6, 1980

[54] CONSTANT CURRENT SUPPLY DRIVE FOR ELECTROCHROMIC DISPLAYS OF THE SEGMENTED TYPE

[75] Inventors: Yasuhiko Inami, Tenri; Tadanori Hishida, Kashihara; Kozo Yano, Tenri; Hiroshi Hamada, Tenri; Hiroshi Také, Nara, all of Japan

[73] Assignee: Sharp Kabushiki Kaisha, Osaka, Japan

[21] Appl. No.: 800,008

[22] Filed: May 24, 1977

[30] Foreign Application Priority Data

May 24, 1976 [JP] Japan ..... 52-60959

[51] Int. Cl.[2] ..... G09F 9/32

[52] U.S. Cl. ..... 340/785; 340/763; 340/811; 350/357

[58] Field of Search ..... 340/324 R, 324 M, 336, 340/378 R, , 763, 785, 811; 350/160 R, 160 P, 357; 58/50 R

[56] References Cited

U.S. PATENT DOCUMENTS

| | | | |
|---|---|---|---|
| 3,096,271 | 7/1963 | Hespenheide | 340/378 R |
| 3,987,433 | 10/1976 | Kennedy | 350/160 R |
| 4,034,550 | 7/1977 | Kouchi et al. | 58/50 R |
| 4,068,148 | 1/1978 | Nomiya et al. | 340/336 |

OTHER PUBLICATIONS

Features of an Electrochromic Display Device, Giglia, Amer. Cyanamid Co.

*Primary Examiner*—Marshall M. Curtis
*Attorney, Agent, or Firm*—Birch, Stewart, Kolasch & Birch

[57] ABSTRACT

A driving circuit is provided for an electro-optical display which includes an electrochromic material and a predetermined number of display segments, various combinations of display segments defining different desired display patterns. The electrochromic phenomenon is developed within the electro-optical display upon a flow of current supplied through the display segments. The driving circuit is constructed so as to supply a predetermined amount of the flow of current to the display segments during variations of the light absorption properties.

18 Claims, 13 Drawing Figures

CONSTANT CURRENT SUPPLY DRIVE FOR ELECTROCHROMIC DISPLAYS OF THE SEGMENTED TYPE

BACKGROUND AND SUMMARY OF THE INVENTION

The present invention relates to a driving circuit for an electrooptical display containing an electrochromic material held in two electrode carrying support plates to manifest reversible variations in the light absorption properties upon current supplied.

An electrochromic material is one in which the color is changed by the application of an electric field or current. See, for example, L. A. Goodman, "Passive Liquid Displays," RCA Report 613258.

The present inventors have discovered that the degree of the coloration of the ECD (electrochromic display) is dependent on the total amount of changes passed through a unit area. That is, the degree of coloration of the ECD increases as the total amount of charge per unit area is increased. Moreover, the present inventors have discovered that the degree of the coloration does not vary even when the temperature varies as long as the total amount of charge passed through a unit area is maintained at a predetermined value.

Generally, in the electro-chemical phenomenon, the electric current flowing through the system is dependent on the temperature when constant potential is supplied. That is, the electric current flowing through the system becomes small as the temperature becomes low. The ECD has a similar characteristic, that is, the response becomes slow as the temperature becomes low. The present invention is based on the above analysis, and is characterized in that a constant current drive is applied to the ECD, thereby eliminating the influence caused by the temperature variations.

Accordingly, an object of the present invention is to provide an improvement in a driving circuit for electrochromic displays which can enhance legibility of a visual display provided by the electrochromic displays.

Another object of the present invention is to provide a constant current supply drive circuit for the electrochromic displays.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, constant current supply sources are provided for the respective segment electrodes included within the electrochromic display. A common electrode confronting the segment electrodes is maintained at the ground potential.

BRIEF DESCRIPTION OF THE DRAWINGS

The present invention will become more fully understood from the detailed description given hereinbelow and the accompanying drawing which are given by way of illustration only, and thus are not limitative of the present invention and wherein.

DESCRIPTION OF THE PREFERRED EMBODIMENTS

Referring now in detail to the drawings, and to facilitate a more complete understanding of the present invention, basic structures of the ECD and the conventional driver circuit of the constant potential type will be first described with reference to FIGS. 1 through 4.

Figure 1:
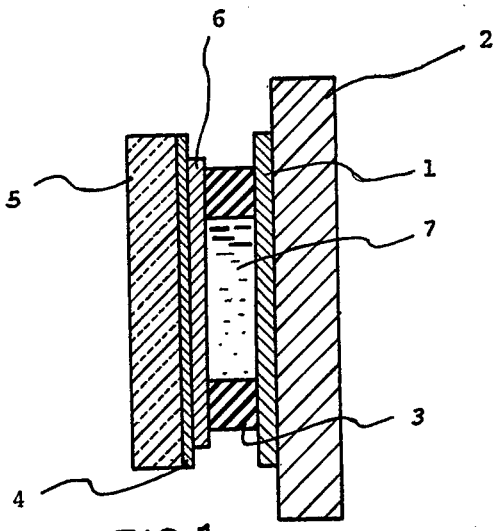
FIG. 1 is a cross sectional view of a basic structure of a solid state ECD.

There are two types of electrochromic displays referred to as ECDs. In one kind, the color variations is produced by the change in the opacity of an inorganic solid film. A typical device structure is shown in FIG. 1, wherein a layer of carbon powder added with binder (registered trademark AQUADAG) is denoted as 1, a stainless plate is denoted as 2. Both the layer 1 and the stainless plate 2 constitute a back electrode. A spacer is denoted as 3; a transparent electrode is denoted as 4; a glass substrate is denoted as 5; an inorganic solid film which manifests the electrochromic phenomenon is denoted as 6; and an electrolyte is denoted as 7. The inorganic film 6 most commonly used for electrocoloration is $WO_3$ with thickness of about 1 $\mu$m. The electrolyte 7 is a mixture of sulfuric acid, an organic alcohol such as glycerol, and a fine white powder such as $TiO_2$. The alcohol is added to dilute the acid and the pigment is used to provide a white reflective background for the coloration phenomenon. The thickness of the liquid is usually about 1 mm. The back electrode is properly selected for effective operation of the device.

The amorphous $WO_3$ film is colored blue when the transparent electrode is made negative with respect to the back electrode. The applied voltage is several volts. Th color can remain for days when the voltage is removed. The blue color is diminished or bleached when the polarity of the applied voltage is reversed. This is termed bleaching.

The coloration of the film apparently is produced by the injection of electrons from the transparent electrode and hydrogen ions (protons) from the electrolyte. Bleaching occures because the electrons and protons are returned to their respective starting electrons when the polarity is reversed.

The second type of ECD utilizes an electrically-induced chemical reduction of a colorless liquid to produce a colored, insoluble film on the cathode surface. In the absence of oxygen, the colored film remains unchanged as long as no current flows. However, the coloration will disappear gradually in the presence of oxygen. This is termed fading. Reversing the voltage causes the film to dissolve into the liquid with the concurrent erasure of the color. The colorless liquid that has met with the most success so far is an aqueous solution of the conducting salt, KBr, and an organic material, heptylviologen bromide, which is the material that produces a purplish film upon electrochemical reduction. Typical voltages are about 1.0 VDC.

Figure 2:
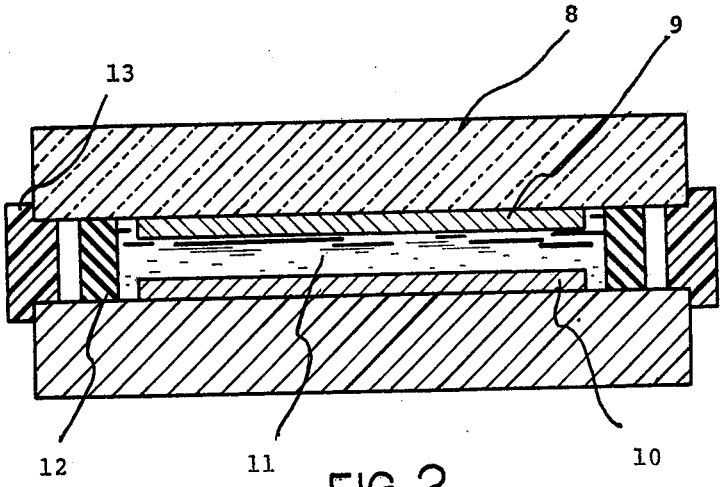
FIG. 2 is a cross sectional view of a basis structure of a liquid state ECD.

The basic cell structure is illustrated in FIG. 2. A glass substrate is denoted as 8; a back or counter electrode is denoted as 9; display electrodes are denoted as 10; a viologen mixture liquid is denoted as 11; a spacer is denoted as 12; and a sealing material is denoted as 13. The fluid thickness is normally about 1 mm thick. The viologen-based ECDs can be used in a transmissive mode if both electrodes are transparent or in a reflective mode if a white reflective substrate is mixed in with the clear electrochromic liquid.

Although the operating principle of ECDs has been discussed above, ECDs have the following characteristic features;

(1) the viewing angle is extremely wide
(2) a plurality of colors are selectable
(3) for a single cycle of coloration/bleaching the power dissipation is several through several tens mj/cm$^2$
(4) memory effects are expected, which maintains the coloration state for several hours through several days after the coloration voltage is removed as long as ECDs are held in an electrically opened state. Of course, the memory effects require no externally supplied power.

Figure 3:
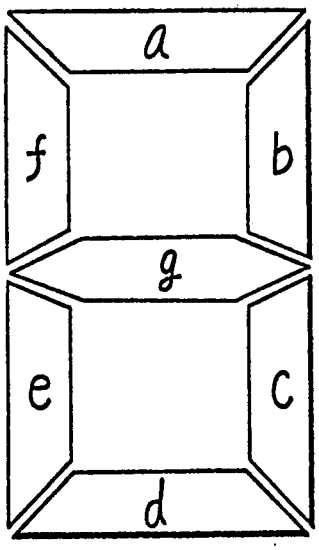
FIG. 3 is a layout of a typical seven-segment numeral display pattern.
Figure 4:
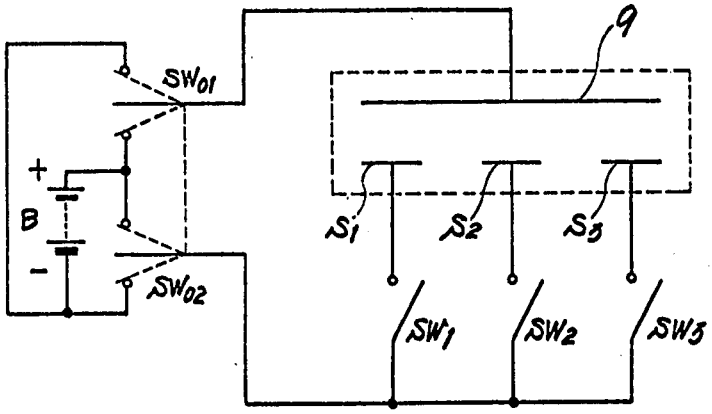
FIG. 4 is a circuit diagram of a typical driver circuit of the constant potential type for ECD.

By way of example, FIG. 4 illustrates a typical driver circuit of the constant potential type for a seven-segment numeral display utilizing the above constructed ECD of which the font is depicted in FIG. 3. Only three segments $S_1$, $S_2$ and $S_3$ are illustrated in FIG. 4 for convenience sake. The driver circuit of FIG. 4 mainly comprises a power source B, polarity selection switches $SW_{01}$ and $SW_{02}$, the switches $SW_{01}$ and $SW_{02}$ being associated with each other, and segment switches $SW_1$, $SW_2$ and $SW_3$.

When only a specific $S_1$ is to be colored, the selection switches $SW_{01}$, and $SW_{02}$ are inclined toward the lower terminals, respectively, and only the segment switch $SW_1$ connected to the segment $S_1$ is closed. At this moment, the electric current flows from the counter electrode 9 to the segment electrode $S_1$ through the electrolyte, thereby coloring the segment $S_1$.

Once the segment $S_1$ is sufficiently colored, at least one of the selection switches $SW_{01}$ and $SW_{02}$ is maintained at the intermediate position to terminate the flow of the electric current. The segment $S_1$ is sustained in the coloration state. Alternatively, the segment $S_1$ is also placed in the memory condition when the segment switch $SW_1$ is opened even when the selection switches $SW_{01}$ and $SW_{02}$ are inclined toward the lower terminals. The coloration tone can be controlled by selectively varying the ON period of the respective segment switches $SW_1$, $SW_2$, and $SW_3$.

Thereafter, when the segment $S_1$ is to be bleached, the selection switches $SW_{01}$ and $SW_{02}$ are inclined toward the upper terminals, respectively, and only the segment switch $SW_1$ connected to the segment $S_1$ is closed. At this moment, the electric current flows from the segment electrode $S_1$ to the counter electrode 9 through the electrolyte, thereby bleaching the segment $S_1$. The degree of the bleaching is also controllable by varying the ON period of the segment switch $SW_1$.

Figure 5:
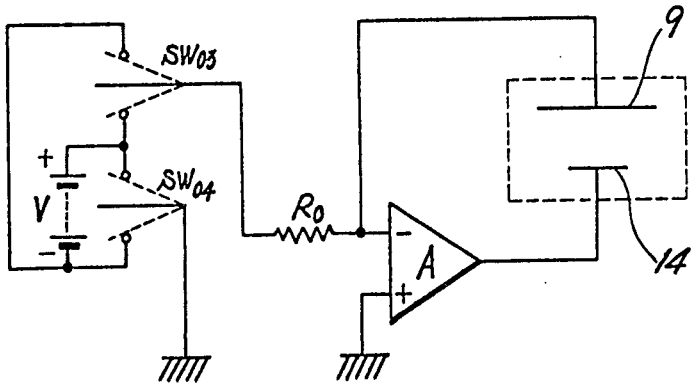
FIG. 5 is a circuit diagram of an embodiment of a driver circuit of the constant current type of the present invention.

FIG. 5 shows an embodiment of a driver circuit of the constant current type of the present invention. The circuit of FIG. 5 mainly comprises the counter electrode 9, a segment electrode 14, an amplifier A, a power source V, a resistor $R_0$, and polarity selection switches $SW_{03}$ and $SW_{04}$.

The coloration operation is performed when the selection switches $SW_{03}$ and $SW_{04}$ are inclined toward the lower terminals, respectively. At this moment, a constant current $V/R_0$ flows through the ECD. After completion of the coloration operation, the selection switch $SW_{03}$ is placed in the intermediate position, whereby the ECD is placed in the memory state. The bleaching operation is performed when the selection switches $SW_{03}$ and $SW_{04}$ are inclined toward the upper terminals, respectively. At this moment, the constant current $V/R_0$ flows through the ECD in the direction counter to that in the coloration operation. After completion of the bleaching operation, the selection switch $SW_{03}$ is placed in the intermediate position to terminate the flow of the electric current.

Figure 6:
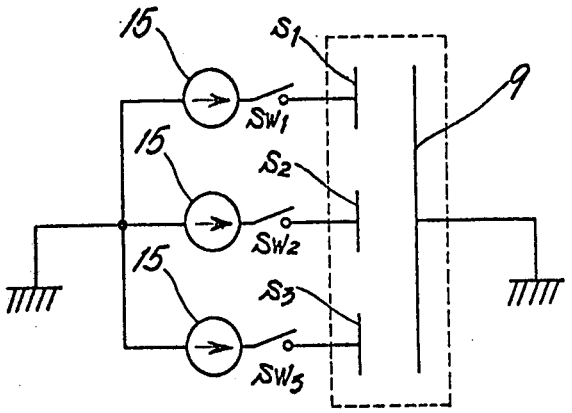
FIG. 6 is a principal circuit diagram of the constant current type driver circuit of the present invention.

FIG. 6 shows a typical construction of the driver circuit of the present invention. A plurality of constant current sources 15 are provided in such a manner to correspond to the respective segments $S_1$, $S_2$ and $S_3$. The segments $S_1$, $S_2$ and $S_3$ are connected to the corresponding constant current sources 15 via the segment switches $SW_1$, $SW_2$ and $SW_3$, respectively.

Now consider a particular condition where the segment $S_1$ is desired to be colored, the segment $S_2$ is desired to be bleached, and the segment $S_3$ is desired to be maintained in the same state. The segment switches $Sw_1$ and $SW_2$ are closed while the segment switch $SW_2$ is maintained open. The constant current source 15 connected to the segment switch $SW_1$ is operated to draw out the constant current from the segment $S_1$, and the constant current source 15 connected to the segment switch $SW_2$ is operated to pour the constant current into the segment $S_2$.

In this way the coloration of the segment $S_1$ and the bleaching of the segment $S_2$ are performed at the same time. This enhances legibility of a visual display even when the display pattern is changed from particular one to another. Moreover, this can minimize the deterioration of the counter electrode 9. When the total amount of the electric current to be drawn out from selected segments and the total amount of the electric current to be poured into selected segments are identical to each other, no current flows through the counter electrode 9. The electric current flowing through the counter electrode 9 corresponds to the difference between the total amount of the drawn out current and the total amount of the electric current poured into the segments.

Needless to say, the coloration and the bleaching can be performed at different moments through the use of the driver circuit of FIG. 6. However, in this case the above-mentioned merits are not expected.

Figure 7:
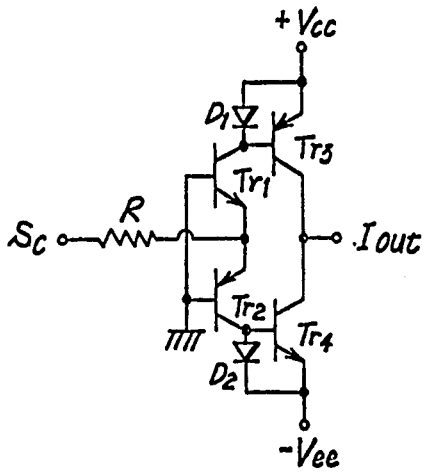
FIG. 7 is a circuit diagram of an embodiment of a constant current source employed within the driver circuit of the present invention.
Figure 8:
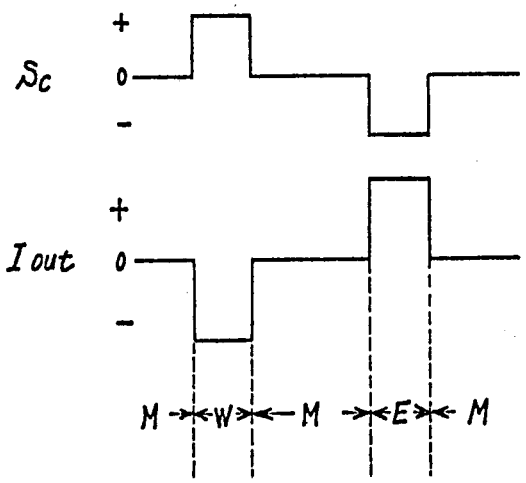
FIG. 8 is a time chart for explaining operation of the constant current source of FIG. 7.

FIG. 7 shows a typical construction of the constant current source employed within the driver circuit of FIG. 6. The constant current source of FIG. 7 mainly comprises power source terminals $+V_{cc}$ and $-V_{ee}$, transistors $Tr_1$ through $Tr_4$, diodes $D_1$ and $D_2$ and a resistor R. The constant current source of FIG. 7 develops a constant current output $I_{out}$ in response to a control signal $S_c$ applied thereto. Operation of the constant current source of FIG. 7 will be described with reference to a time chart of FIG. 8, wherein M designates a memory period, W designates a coloration period, and E designates a bleaching period.

When the control signal $S_c$ bears a level "0," the transistors $Tr_1$ and $Tr_2$ are OFF and, hence, the transistors $Tr_3$ and $Tr_4$ are maintained OFF. Accordingly, the segment connected to the constant current source is placed in the memory state. When the control signal $S_c$ bears a positive level "+," the transistor $Tr_2$ is turned ON and, therefore, the transistor $Tr_4$ becomes ON via the diode $D_2$. In the case where the diode $D_2$ has a similar characteristic as the base junction of the transistor $Tr_4$, the collector current of the transistor $Tr_4$ becomes identical to that of the transistor $Tr_2$. It will be clear from FIG. 7 that the collector current of the transistor $Tr_2$ is controlled by the level of the control signal $S_c$ and the resistance value of the resistor R. Consequently, when the control signal $S_c$ takes the positive level, the transistor $Tr_4$ functions to draw out the constant current, whereby the segment is colored.

After completion of the coloration to a desired tone, the control signal $S_c$ is returned to the level "0." The segment is placed in the memory state due to the backward biased collector junction of the transistores $Tr_3$ and $Tr_4$. When the control signal Sc bears a negative level "−," the transistors $Tr_1$ and $Tr_3$ and the diode $D_1$ are ON. The transistor $Tr_3$ functions to pour the constant current into the segment for bleaching purposes, since the collector current of the transistor $Tr_1$ is controlled to take a predetermined value by the resistor R.

As discussed above, in accordance with the driver circuit of FIG. 7, the constant current controlled coloration, bleaching and sustaining are performed by controlling a potential to be applied to one terminal. The value of the constant current should be determined by taking account of the segment size and the preferred response.

When the ECD is driven by the constant current, a potential difference is created between the counter electrode and the segment electrode in a fashion dependent on the degree of the coloration. A large potential difference created between the counter electrode and the segment electrode will influence the life time of the ECD. Especially when the segment electrode is made of $WO_3$, a high resistance is created during the bleaching. Therefore, the potential difference is considerably high near the end of the bleaching operation. In order to avoid undesirable influences, the voltages for the terminals $+V_{cc}$ and $-V_{ee}$ should be selected below four (4) volts. In this case, the transistors $Tr_3$ and $Tr_4$ are placed into the saturation states before the undesirable reaction occurs within the ECD, whereby the ECD is driven by the constant voltage basis rather than the constant current basis.

Figure 9:
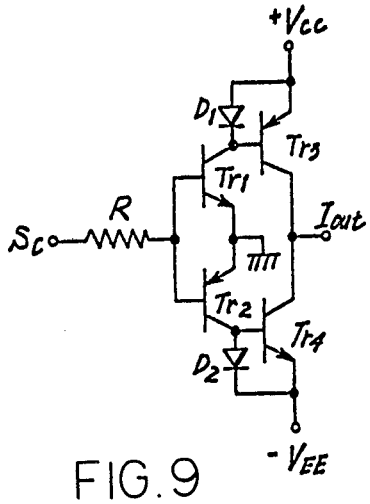
FIGS. 9 through 11 are circuit diagrams of other embodiments of the constant current source employed within the driver circuit of the present invention.
Figure 10:
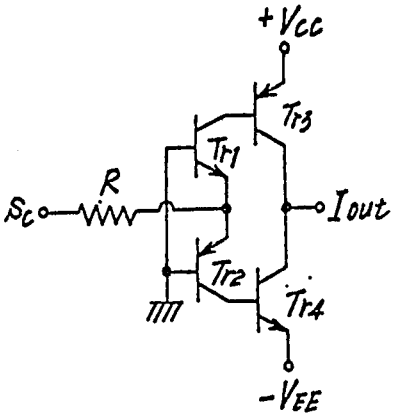
Figure 11:
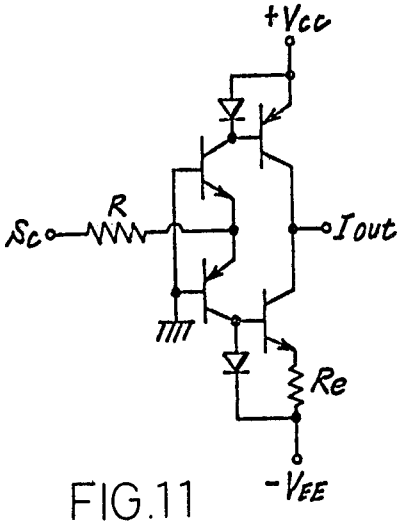

FIGS. 9 through 11 show other examples of the constant current source. The circuits of FIG. 10 functions in a same manner as that of FIG. 7. The circuit of FIG. 9 utilizes the current-amplification factors of the transistors $Tr_1$ and $Tr_2$. In addition, in FIG. 9, since the signal from $S_c$ is connected to the base of transistors $Tr_1$ and $Tr_2$, in lieu of the emitters as in FIGS. 10 and 11, when $S_c$ is high, the direction of flow of current $I_{out}$ in FIG. 9 will be opposite to the direction of flow of $I_{out}$ in FIGS. 10 and 11. Consequently, when the circuit of FIG. 9 is in a coloration cycle with a high $S_c$, the circuits of FIGS. 10 and 11 will be experiencing a bleaching cycle for the same high $S_c$. The circuit of FIG. 10 utilizes the current-amplification factors of the transistors $Tr_3$ and $Tr_4$. Therefore, the circuits of FIGS. 9 and 10 can minimize the current flowing through the resistor R. The constant current source of FIG. 11 includes a resistor $R_e$ which functions to increase the bleaching current as compared with the coloration current.

Figure 12:
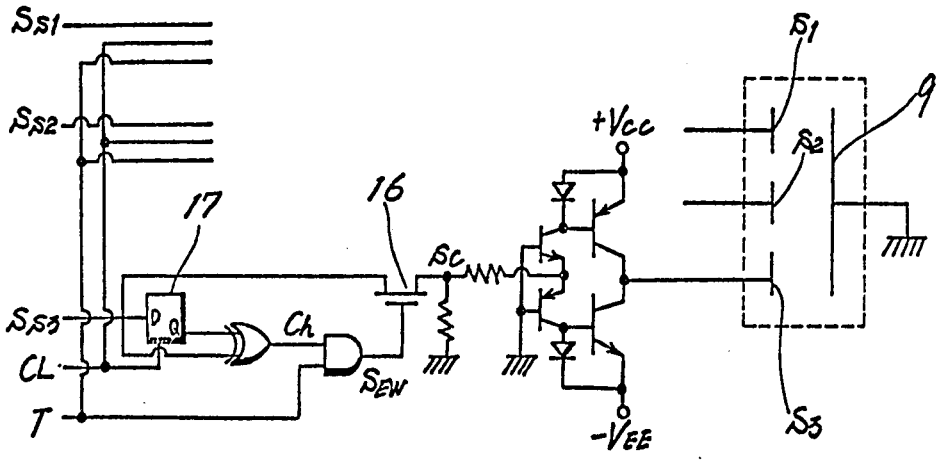
FIG. 12 a circuit diagram of an embodiment of a driver circuit of the present invention.

FIG. 12 shows a typical construction of the driver circuit of the present invention. Only one driver circuit connected to the segment $S_3$ is illustrated in FIG. 12 for convenience sake.

Figure 13:
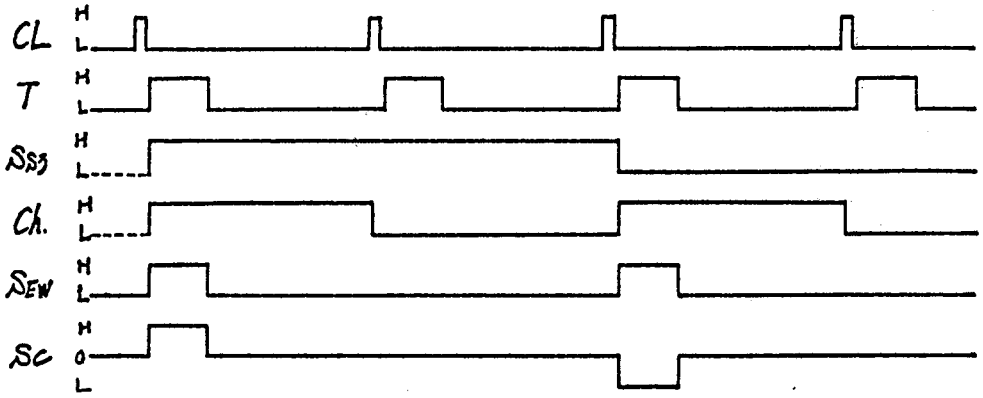
FIG. 13 is a time chart for explaining operation of the driver circuit of FIG. 12.

The driver circuit of FIG. 12 mainly comprises an analogue switch 16, a D-type flip-flop 17 and the constant current source shown in FIG. 7. FIG. 13 shows various signals occurring within the driver circuit of FIG. 12. A segment selection signal $S_{s3}$ is applied to the D-type flip-flop 17. Segment selection signals $S_{s1}$ and $S_{s2}$ are associated with the segments $S_1$ and $S_2$, respectively. H represents the colored state and L represents the bleached state. A clock signal CL is applied to the D-type flip-flop 17. A timing signal T functions to determine the period of time during which the current flows through the ECD. That is, the coloration current or the bleaching current flows during a time period when the timing signal T bears the level "H."

A signal Ch shows changes of the segment selection signal. The signal Ch bears a high level H during a time period when the clock signal CL continuously takes the low level L upon changing of the segment selection signal. A signal $S_{EW}$ is a product of the timing signal T and the signal Ch. The signal $S_{EW}$ takes the high level H during a time period when the coloration current or the bleaching current is forced to flow through the ECD. The signal $S_{EW}$ functions to turn on the analogue switch 16.

The analogue switch 16 functions to develop the control signal $S_c$ in response to the segement selection signal $S_{s3}$ and the signal $S_{EW}$. The control signal $S_c$ derived from the analogue switch 16 takes the high level H when the segment selection signal $S_{s3}$ is changed to the high level H. The time period of the control signal $S_c$ is controlled by the signal $S_{EW}$ which is applied to the gate electrode of the analogue switch 16. The control signal $S_c$ takes the low level L when the segment selection signal $S_{s3}$ is changed to the low level L. The control signal $S_c$ takes the level "0" when the signal $S_{EW}$ bears the low level L, whereby the segment is placed in the memory state since the output of the constant current source becomes the high impedance.

The trailing edge of the clock signal CL appears slightly before the leading edges of the remaining signals.

The invention being thus described, it will be obvious that the same way be varied in many ways. Such variations are not to be regarded as a departure from the spirit and scope of the invention, and all such modifications are intended to be included within the scope of the following claims.

What is claimed is:

1. In a driver circuit for an electrochromic display which includes an electrochromic material and a predetermined number of display segments, combinations of the display segments defining different desired display patterns, the improvement comprising:

a plurality of constant current supply source means one of said constant current supply source means being connected to each of the respective display segments for causing an electric current of an individually fixed value to flow through said display segments; and control means for selectively enabling each of said constant current supply source means thereby causing electric current of a fixed value to be drawn through said constant current supply source means connected to said display segment and drawn from the respective display segment when said respective display segment is desired to be colored and causing electric current of a fixed value to be poured into the display segment and conducted through said constant current supply source means connected to said display segment when said display segment is desired to be bleached.

2. The driver circuit of claim 1, wherein the coloration of a particular display segment and the bleaching of another display segment are conducted at the same time.

3. The invention defined in claim 1, wherein said electrochromic display includes a counter electrode for said segment electrodes; and said driver circuit further includes means for maintaining said counter electrode at ground potential.

4. The invention defined in claim 3, wherein the coloration of a particular display segment and the bleaching of another display segment are conducted at the same time.

5. The invention defined in claim 1, wherein:

said display segments are placed in colored and bleached states, respectively, by reversing the direction of current flow thereto in coloring and bleaching operations; and said constant current supply source includes means for limiting current flow through said display segments prior to the end of a said bleaching operation.

6. The invention defined in claim 5, wherein the coloration of a particular display segment and the bleaching of another display segment are conducted at the same time.

7. The invention defined in claim 3, wherein said driver circuit further includes means for maintaining the potential difference created between said counter electrode and said display segments below a predetermined value.

8. The invention defined in claim 7, wherein the coloration of a particular display segment and the bleaching of another display segment are conducted at the same time.

9. The invention defined in claim 1, wherein:

said display segments are placed in colored and bleached states, respectively, by reversing the direction of current flow thereto in coloring and bleaching operation; and said constant current supply source includes means for limiting current flow through said display segments prior to the end of a said bleaching operation; and said electrochromic display includes a counter electrode for said segment electrodes; and said driver circuit further includes means for maintaining said counter electrode at ground potential.

10. The invention defined in claim 9, wherein the coloration of a particular display segment and the bleaching of another display segment are conducted at the same time.

11. The invention defined in claim 9, wherein said driver circuit further includes means for maintaining the potential difference created between said counter electrode and said display segments below a predetermined value.

12. The invention defined in claim 11, wherein the coloration of a particular display segment and the bleaching of another display segment are conducted at the same time.

13. A driver circuit for an electrochromic display which includes an electrochromic material, a predetermined number of display segments, various combinations of the display segments defining different desired display patterns, and a counter electrode for said display segments, said driver circuit comprising:

a plurality of constant current supply source means being connected one to each of said respective display segments for causing an electric current of a fixed value to flow through said display segments;

control means for selectively enabling each of said constant current supply source means; and means for maintaining said counter electrode at ground potential;

said control means causing said plurality of constant current supply source means to color and to bleach respectively associated selected display segments substantially simultaneously.

14. A driver circuit for an electrochormic display in accordance with claim 13, wherein the control means function to draw electric current of fixed value from the display segment when said display segment is desired to be colored, and function to pour electric current of fixed value into the display segment when said display segment is desired to be bleached.

15. A driver circuit for an electrochromic display in accordance with claim 14, wherein:

said display segments are placed in colored and bleached states, respectively, by reversing the direction of current flow thereto in coloring and bleaching operations; and said constant current supply source means includes means for limiting current flow through said display segments prior to the end of a said bleaching operation.

16. A driver circuit for an electrochromic display in accordance with claim 15, wherein said driver circuit further includes means for maintaining the potential difference created between said counter electrode and said display segments below a predetermined value.

17. A driver circuit for an electrochromic display which includes an electrochromic material and a predetermined number of display segments, various combinations of the display segments defining different desired display patterns, said driver circuit comprising:

a plurality of constant current supply source means, one of said source means being connected to each of said display segments for causing an electric current of a fixed value to flow through said display segments, said constant current supply source means providing a coloration current, for coloring said display segment, said coloration current flowing in one direction, and providing a bleaching current, to bleach said display segment, said bleaching current flowing in an opposite direction; and current direction determining means connected to an input of each of said constant current supply source means for determining the direction of flow of said current through each of said constant current supply source means in response to the application of a coloration command and a bleaching command to said current direction determining means.

18. A driver circuit for an electrochromic display which includes an electrochromic material and a predetermined number of display segments, various combinations of the display segments defining different desired display patterns, said driver circuit comprising:

a constant current supply source means connected to at least one of said display segments of said electrochromic display;

said supply source means responding to both a coloration command and a bleaching command;

said supply source means generating a coloration current of a fixed value, for coloring said at least one of said display segments in response to application of said coloration command, said coloration current flowing in a first direction;

said supply source means generating a bleaching current of a fixed value, for bleaching said display segment in response to application of said bleaching command, said bleaching current flowing in a second direction opposite to said coloration current.

* * * * *